United States Patent [19]

Very

[11] Patent Number: 4,752,004

[45] Date of Patent: Jun. 21, 1988

[54] PROTECTIVE COVER FOR GOLF BAG

[76] Inventor: Ronald A. Very, 122 Lake Placid Close S. E., Calgary; Alberta, Canada, T2J 5A5

[21] Appl. No.: 64,547

[22] Filed: Jun. 22, 1987

[30] Foreign Application Priority Data

Apr. 27, 1987 [CA] Canada ..... 535587

[51] Int. Cl.[4] ..... A63B 55/00; A63B 57/00

[52] U.S. Cl. ..... 206/315.4; 150/52 G

[58] Field of Search ..... 150/52 G, 52 E, 52 F; 190/26; 206/315.3, 315.2, 315.4–315.8; 383/86, 87

[56] References Cited

U.S. PATENT DOCUMENTS

| | | | |
|---|---|---|---|
| D. 256,293 | 8/1980 | Edwards | 206/315.4 X |
| 1,119,508 | 12/1914 | Headley | 206/315.4 |
| 2,396,021 | 3/1946 | Schloss | 150/52 G |
| 2,693,836 | 11/1954 | Hayes | 383/87 X |
| 2,907,364 | 10/1959 | Trenery | 206/315.4 X |
| 2,973,794 | 3/1961 | Erickson | 150/52 G |
| 2,985,212 | 5/1961 | Dozier | 150/52 G |
| 3,059,681 | 10/1962 | Lorbeski | 150/52 G |
| 3,255,794 | 6/1966 | Morse | 150/52 G |
| 3,620,276 | 11/1971 | Taylor | 150/52 G |
| 3,754,587 | 8/1973 | Rainieri | 150/52 G |
| 3,913,648 | 10/1975 | Sessler | 206/315.4 |
| 3,985,171 | 10/1976 | Summers et al. | 150/52 G |
| 4,200,133 | 4/1980 | Whitlow | 150/52 G |
| 4,234,025 | 11/1980 | Berge | 150/52 G X |
| 4,453,632 | 6/1984 | Clower | 206/315.4 |
| 4,474,388 | 10/1984 | Wagner | 206/315.4 X |
| 4,498,579 | 2/1985 | Brick | 206/315.4 |

FOREIGN PATENT DOCUMENTS

| | | | |
|---|---|---|---|
| 214516 | 7/1941 | Switzerland | 150/52 F |
| 1230580 | 5/1971 | United Kingdom | 206/315.3 |

*Primary Examiner*—William Price
*Assistant Examiner*—Sue A. Weaver
*Attorney, Agent, or Firm*—Nies, Webner, Kurz & Bergert

[57] ABSTRACT

A golf bag protective cover composed of plastic sheet material having slit openings therein which are covered by a plastic skirt which circumvents the entire cover, thus preventing dislodgment by wind while protecting the interior of the golf bag against ingress of rain.

5 Claims, 2 Drawing Sheets

PROTECTIVE COVER FOR GOLF BAG

FIELD OF INVENTION

This relates to covers for mounting on golf bags to protect the clubs against the weather.

BACKGROUND OF THE INVENTION

Various types of golf bag covers have been proposed in the prior art. Examples of such proposals are found in U.S. Pat. Nos. 4,200,133, 3,754,587, 2,985,212, 2,973,794 and 3,620,276. None of these United States patents discloses a device wherein the entire top portion of the envelope is covered by a slit cover in the form of a skirt which completely surrounds the envelope and covers the openings therein. Such skirt provides protection against rain running down the envelope into the slit opening during removal of the golf clubs and also avoids the necessity of a device for holding the slit cover against displacement by wind.

SUMMARY OF THE INVENTION

The present invention discloses a golf bag cover having slit openings therein situated at different levels for positioning the upper slit adjacent the longer clubs and positioning the lower slit adjacent the shorter clubs thus permitting easier removal and replacement thereof. The invention also provides a cover for the slit openings, in the form of a skirt which completely surrounds the portion of the envelope containing the slits. The cover is thus adapted to avoid displacement by the wind while avoiding the necessity of a separate mechanism to hold the cover in place. Moreover the slot cover in the form of a skirt provides protection against rain entering into the slits either directly or by running down the envelope situated above the slits, while the clubs are being removed therefrom. Because the cover is in the form of a skirt which completely surrounds the envelopes the slit openings are not confined to one particular side as in the case of a flap. Rather the slits may be formed at different points in the circumference of the tubular envelope thus making access to the clubs easier.

The present invention also provides a method of manufacturing such a golf club protective device which is simple and inexpensive to manufacture.

In accordance with the present invention there is provided a golf club protective device comprising: an envelope portion comprising a generally tubular wall having first and second ends; said first end being unsealed to form an opening for mounting said device on a golf bag and said second end being sealed; opening means in said wall to permit passage of golf clubs therethrough; a skirt portion comprising a generally tubular wall having first and second ends; said first end of said skirt in sealing engagement with said second end of said envelope portion; said skirt bag being adapted to overlay the portion of said envelope from said second end to a point beyond said opening means; fastening means on said envelope portion adjacent said first end thereof to permit said device to be fastened to the golf bag.

In accordance with another aspect of the invention there is provided a method of manufacturing a golf club protective device comprising: cutting a sheet plastic tube to length; forming transverse slits in said tube; heat sealing the tube along a transverse line so that said slits are on one side of said heat seal line; folding the portion of the tube not having slits therein over the portion having slits, along said heat seal line; attaching fastening means to the device.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENTS

Figure 2:
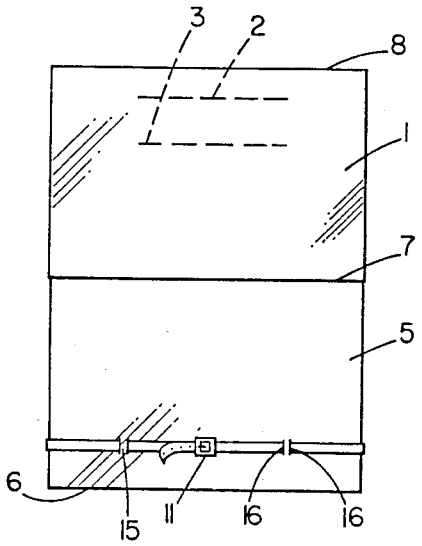
FIG. 2 is an illustration of the invention in its completed form.
Figure 3:
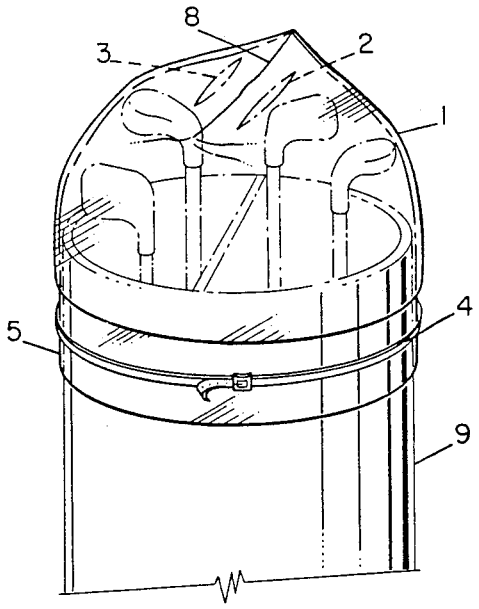
FIG. 3 is a perspective view of the invention mounted on a golf bag.

With reference to FIG. 2, the protective cover comprises a tubular envelope 5 composed of clear plastic flexible sheeting. The tubular envelope includes an open end 6 and a sealed end 8. Situated on opposite sides of the walls of the envelope 5 are slit openings 2 and 3 which are adapted to permit access to the inside of the envelope. Covering the end of the tubular envelope 8 having the slit openings 2 and 3, is a skirt 1 which is sealed along seam 8 and is open between the lower edge 7 thereof and the wall of the envelope 5. A belt 4 composed of a plastic material having a buckle 11 for tightening is mounted near the bottom of the tubular envelope 5.

Figure 1:
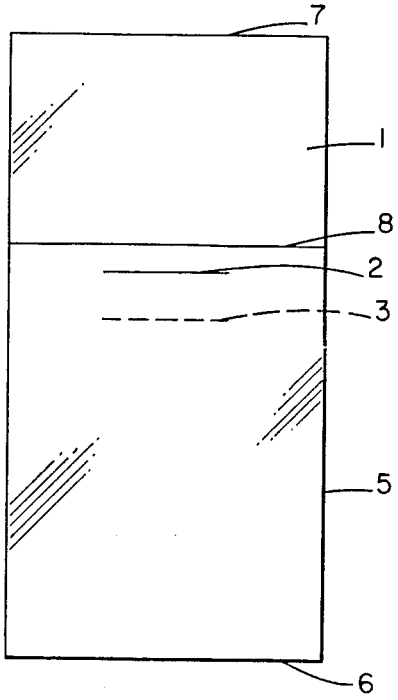
FIG. 1 is a drawing illustrating a stage in the manufacture of a device in accordance with the invention.
Figure 4:
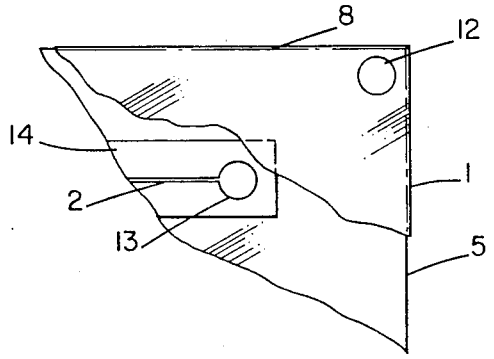
FIG. 4 is a portion of the device of FIG. 2 illustrated in a larger scale.

In the manufacture of the protective cover a single tubular sheet plastic length is used to form both the envelope 5 and the skirt 1. As shown in FIG. 1 slits 2 and 3 are formed in opposite sides of the plastic tube in the area of the envelope 5. In order to prevent tearing during use, the slits may be terminated by circular openings 13 and may include a reinforcing panel 14 surrounding it as shown in FIG. 4.

Belt loops 15 for maintaining the belt 4 in position may be formed toward the bottom of the envelope 5 by cutting short longitudinal slits 16 therein following which the belt 14 is threaded through the belt loops 15 into the position shown.

A linear transverse heat seal 8 is then formed to divide the envelope 5 from the skirt 1 after which the skirt 1 is folded downwardly over the top of the envelope 5 to cover the slits 3 and 2.

In order to reduce the tendency of the skirt to move upwardly heat seals 12 may be formed in the upper corners to adhere the skirt to the envelope in the location of the heat seals.

As an alternative to applying heat seals 12 the layers of plastic may be sewn together at the corners using reinforcing circular patches on the outside. As a further alternative to applying heat seals 12 at the corners, a narrow plastic strip may be folded over the entire length of the edge 8 and be sewn thereto or be heat sealed thereto.

In use, the unsealed end 6 of the envelope 5 is placed over the top of the golf bag 9 and the buckle 11 is tightened causing the belt 4 to hold the cover in place. In placing the cover over the golf club it is positioned so that the upper slit 2 is adjacent the longer clubs and the lower slit 1 is adjacent the shorter clubs in the bag.

In order to remove or replace the clubs the skirt is lifted to provide access to the slit thereunder. In such position the skirt still provides a very substantial degree of protection against ingress of rain directly into the slit and against ingress by running down the device into the slit. The arrangement of the skirt also prevents rain which has contacted the cover from running down into the slit. It is not necessary to fasten the skirt against being displaced by wind since by its construction, it resists displacement.

The embodiments of the invention in which an exclusive property or privilege is claimed are defined as follows:

1. A golf club protective device comprising: an envelope portion comprising a generally tubular first wall having first and second ends; said first end of said envelope portion being unsealed to form an opening for mounting said device on a golf bag and said second end of said envelope portion being sealed; opening means in said first wall to permit passage of golf clubs therethrough; a skirt portion comprising a generally tubular second wall having first and second ends; said first end of said skirt portion being in sealing engagement with said second end of said envelope portion; said skirt portion being adapted to overlay the portion of said envelope portion from said second end of said envelope portion to a point beyond said opening means; fastening means on said envelope portion adjacent said first end thereof to permit said device to be fastened to a golf bag; and said opening means comprises a first transverse slit on one side of said wall of said envelope portion and a second transverse slit on the opposite side of said wall of said envelope portion, the position of said first slit being nearer to said second end of said envelope portion than that of said second transverse slit, whereby said device is adapted to be positioned on a golf bag so that said first slit is adjacent longer clubs in the bag.

2. A golf club protective device of as defined in claim 1 wherein said envelope portion and skirt portion are formed from a single sheet of plastic material, said plastic being formed into a tube, a heat seal formed along a transverse line across the tube and a portion of the tube being folded along the line of the heat seal to overlay part of the remaining portion of the tube.

3. A golf club protective device comprising: an envelope portion comprising a generally tubular first wall having first and second ends; said first end of said envelope portion being unsealed to form an opening for mounting said device on a golf bag and said second end of said envelope portion being sealed; opening means in said first wall to permit passage of golf clubs therethrough; a skirt portion comprising a generally tubular second wall having first and second ends; first end of said skirt portion being in sealing engagement with said second end of said envelope portion; said skirt portion being adapted to overlay the portion of said envelope portion from said second end of said envelope portion to a point beyond said opening means; fastening means on said envelope portion adjacent said first end thereof to permit said device to be fastened to a golf bag; said envelope portion and skirt portion comprising a single sheet of plastic material, said single plastic sheet being formed into a tube, a heat sealing closing said tube at an intermediate location thereof and formed along a transverse line across the tube, and a portion of the tube constituting said skirt portion being folded along the line of the heat seal to overlay part of the remaining portion of the tube which constitutes said envelope portion.

4. A golf club protective device as defined in claim 3 wherein said opening means comprises a transverse slit in said wall of said envelope portion adjacent said second end of said envelope portion.

5. A golf club protective device as defined in claims 1,2,3 or 4 wherein said envelope portion and said skirt portion are composed of clear plastic sheet material and said fastening means comprises a strap and buckle, said device being adapted to be mounted on a golf bag with the skirt portion covering said opening means to prevent the ingress of rain while permitting access to the opening means by lifting the skirt portion.

* * * * *